United States Patent [19]

Vergara et al.

[11] Patent Number: 4,706,011

[45] Date of Patent: Nov. 10, 1987

[54] HIGH VOLTAGE PULSE DETECTOR WITH CONTROLLABLE CURRENT CONSUMPTION

[75] Inventors: Sossio Vergara, Frattamaggiore, Italy; Sebastiano D'Arrigo, Houston, Tex.; Giuliano Imondi, Rieti, Italy

[73] Assignee: Texas Instruments Incorporated, Dallas, Tex.

[21] Appl. No.: 882,557

[22] Filed: Jul. 7, 1986

[51] Int. Cl.[4] ..... G05F 1/565

[52] U.S. Cl. ..... 323/274; 323/284; 307/358; 307/362; 307/363

[58] Field of Search ..... 323/274, 280, 281, 284; 324/76 R; 307/358, 362, 363, 464

[56] References Cited

U.S. PATENT DOCUMENTS 3,571,694 3/1971 Hunger et al. ..... 324/76 R X 4,585,955 4/1986 Uchida ..... 323/281 X

*Primary Examiner*—Peter S. Wong

*Assistant Examiner*—Emanuel Todd Voeltz

*Attorney, Agent, or Firm*—John G. Graham; Robert Groover, III

[57] ABSTRACT

A circuit for sensing a voltage present on an input line higher than a supply voltage $V_{DD}$ which includes an isolation switch coupled between the input line and an output line, a threshold adjustment diode coupled in series with the isolation switch also between the input and output lines for establishing a voltage above $V_{DD}$ at which the isolation switch turns on and a constant current source coupled from an output of the sensing circuit and ground.

6 Claims, 2 Drawing Figures

HIGH VOLTAGE PULSE DETECTOR WITH CONTROLLABLE CURRENT CONSUMPTION

BACKGROUND OF THE INVENTION

The present invention relates to a high voltage pulse detector for sensing a voltage higher than a circuit supply voltage applied to a circuit terminal and for outputting a logic level signal in the latter case.

Traditionally it has been the practice to use an isolation transistor between an input line and an output line together with series connected diodes to establish a threshold with respect to the supply voltage above which an input voltage will produce an output signal indicating the presence of an input voltage greater than the supply voltage. The output signal must be at a logic level in order to protect subsequent devices. The problem with the foregoing approach has been due to the relatively high uncertainty of the threshold due to the effects of varying temperature and other factors and the dramatic increase of current consumption with increasing input voltage above the threshold.

Accordingly, it is a principal object of the present invention to provide an improved circuit for sensing the presence of an input voltage greater than the limit voltage.

SUMMARY OF THE INVENTION

According to the present invention there is provided a circuit for sensing a voltage present on an input line higher than a supply voltage $V_{DD}$ which includes an isolation switch coupled between the input line and an output line, a threshold adjustment diode coupled in series with the isolation switch also located between the input and output lines for establishing a voltage above $V_{DD}$ at which the isolation switch turns on and a constant current source coupled from an output of the sensing circuit and ground.

Preferably an output voltage limiting circuit is also coupled in series with said isolation switch between the input and output lines.

BRIEF DESCRIPTION OF THE DRAWINGS

The novel features believed characteristic of the invention are set forth in the appended claims. The invention itself, however, as well as other features ad advantages thereof, will be best understood by reference to the detailed description which follows, read in conjunction with the accompanying drawings, wherein:

DETAILED DESCRIPTION WITH REFERENCE TO THE DRAWINGS

Figure 1:
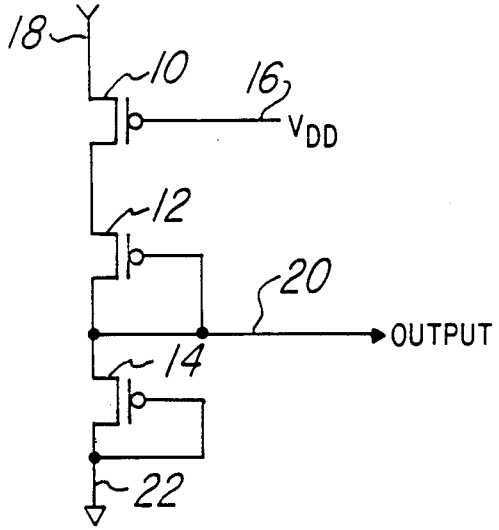
Fig. 1 PRIOR ART
FIG. 1 is a circuit diagram of a prior art technique used for sensing an input voltage higher than the supply voltage.

Referring to FIG. 1, there is shown a circuit which is in use for detecting the presence of an input voltage on an input line 18 which is higher than a supply voltage $V_{DD}$. The circuit consists of an isolation transistor 10 of the P-channel MOSFET type whose gate is coupled to a $V_{DD}$ line 16. A pair of P-channel MOSFET type transistors 12 and 14 connected in series as diodes to ground 22 establish the threshold above which an output signal is generated on output line 20 in response to an input signal greater than the limit voltage $V_{DD}$ by the threshold amount. Since the thresholds of transistors 10, 12, and 14 are strongly dependent on temperature as well as on substrate bias (the body effect) there is considerable uncertainty of this threshold value. Moreover, because of the diode characteristics of transistors 12 and 14, an increase in voltage above the threshold results in a very large increase in current.

Figure 2:
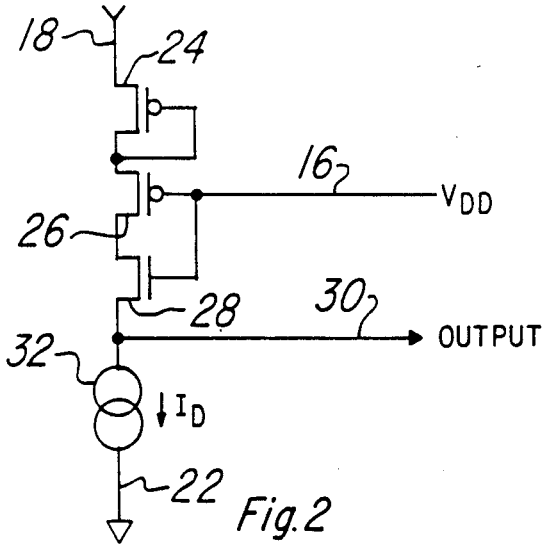
FIG. 2 is a circuit diagram of a technique according to a preferred embodiment of the present invention for sensing an input voltage higher than a supply voltage $V_{DD}$.

The circuit of FIG. 2 overcomes the foregoing difficulties. Here a diode connected P-channel MOSFET transistor 24 is coupled to input line 18 followed by a P-channel MOSFET type isolation transistor 26. The gate of transistor 26 is connected to $V_{DD}$ supply line 16. An N-channel transistor 28 is connected in series with transistor 26 and has its gate connected to $V_{DD}$ line 16 as well. The source of transistor 28 connects to an output line 30 as well as to a constant current source 32 the other end of which is connected to ground line 22.

The constant current source 32 fixes the maximum current that can flow in the circuit other than for any output current that may be drawn. Transistor 26 acts as an isolation transistor in not turning on until the voltage on its drain is greater than $V_{DD}$. Transistor 28 acts as an output voltage limiter in passing only a maximum of $V_{DD}$ onto output line 30. Diode connected transistor 24 provides a one diode threshold to the overall threshold as determined by the sizes of transistors 24, 26, 28 and the current of constant current source 32. When the input voltage on line 18 is below the limit voltage $V_{DD}$ then the output is tied to ground by the current generator 32. When the input voltage goes beyond the threshold, transistor 24, 26 and 28 and current generator 32 turn on. When the current through the latter transistors increase beyond that which the current generator is capable of pumping then the output voltage increases to the supply voltage fixing the maximum current flowing from the input. Thus, the maximum current that can flow is independent of the input voltage beyond a certain point and also independent of temperature.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is, therefore, contemplated that the appended claims will cover any such modifications or embodiments as fall within the true scope of the invention.

What is claimed is:

1. A CMOS circuit for sensing a voltage present on an input line and for providing an output signal on an output line thereof when the voltage on the input line exceeds a limit voltage $V_{DD}$, comprising:

an isolation P-channel MOS field effect transistor having a source-to-drain path coupled between the input and output lines for isolating the input and output lines when the input voltage is less than $V_{DD}$ and a gate coupled to a limit voltage source;

a threshold adjustment MOS transistor connected as a diode in series with said isolation transistor between the input and output lines; and a constant current source coupled from the output line to ground.

2. A circuit according to claim 1, including an output voltage limiting circuit in series with said isolation transistor.

3. A circuit according to claim 1, wherein said threshold adjustment transistor is a P-channel MOSFET transistor whose gate is coupled to its source.

4. A circuit according to claim 2, wherein said output voltage limiting circuit is an N-channel MOSFET transistor having a gate connected to $V_{DD}$ and a source connected to the output line.

5. A circuit for sensing a voltage present on an input line when the voltage on the input line exceeds a limit voltage $V_{DD}$, comprising:

an isolation P-channel MOS field effect transistor having a source-to-drain path coupled between the input and output lines for isolating the input and output lines when the input voltage is less than $V_{DD}$ and a gate coupled to a limit voltage source;

a threshold adjustment MOS transistor connected as a diode in series with said isolation transistor between the input and output lines;

an N-channel MOSFET transistor having a gate connected to $V_{DD}$ and a source connected to the input line; and a constant current source coupled from the output line to ground.

6. A method of sensing an input voltage on an input line and, if higher by a predetermined threshold amount than a limit voltage $V_{DD}$, providing an output signal on an output line in the latter event, comprising:

applying a limit voltage $v_{DD}$ to a gate of a MOSFET switch transistor having a source-to-drain path in series with the input and output lines; and establishing a maximum current that can flow through the switch in response to increased voltage on the input line.

* * * * *

UNITED STATES PATENT AND TRADEMARK OFFICE

CERTIFICATE OF CORRECTION

PATENT NO. : 4,706,011

DATED : November 10, 1987

INVENTOR(S) : Sossio Vergara, Sebastiano D'Arrigo, and Giuliano Imondi

It is certified that error appears in the above-identified patent and that said Letters Patent is hereby corrected as shown below:

Column 4, line 5, change "input" to --output--.

Signed and Sealed this

Tenth Day of October, 1995

*Attest:*

Bruce Lehman

BRUCE LEHMAN

*Attesting Officer*

*Commissioner of Patents and Trademarks*